US006151761A

United States Patent [19]

Thompson

[11] Patent Number: 6,151,761

[45] Date of Patent: Nov. 28, 2000

[54] FLEXIBLE RESTRAINING DEVICE

[76] Inventor: Greg Thompson, 205 Town Creek Dr., Apex, N.C. 27502

[21] Appl. No.: 09/161,575

[22] Filed: Sep. 28, 1998

[51] Int. Cl.[7] ..... E05B 75/00

[52] U.S. Cl. ..... 24/16 PB

[58] Field of Search ..... 24/16 PB, 30.5 P, 24/16 R; 70/14, 15, 16; 128/876, 878, 879, 881, 882

[56] References Cited

U.S. PATENT DOCUMENTS

| | | | |
|---|---|---|---|
| D. 256,438 | 8/1980 | Woods . | |
| 2,262,664 | 11/1941 | Bresson . | |
| 2,977,145 | 3/1961 | Rifkin . | |
| 3,186,047 | 6/1965 | Schwester et al. . | |
| 3,731,347 | 5/1973 | Caveney et al. | 24/16 PB |
| 4,910,831 | 3/1990 | Bingold . | |
| 5,088,158 | 2/1992 | Burkholder . | |
| 5,102,075 | 4/1992 | Dyer | 24/16 PB X |
| 5,159,728 | 11/1992 | Bingold . | |
| 5,377,387 | 1/1995 | Freed | 24/16 PB |
| 5,398,383 | 3/1995 | Bingold | 24/16 PB |
| 5,443,155 | 8/1995 | Robinson . | |
| 5,452,523 | 9/1995 | Jansen . | |
| 5,537,719 | 7/1996 | Freed | 24/16 PB |
| 5,621,949 | 4/1997 | Wells et al. . | |
| 5,956,813 | 9/1999 | Cooper | 24/16 PB |

*Primary Examiner*—James R. Brittain
*Attorney, Agent, or Firm*—Coats & Bennett, PLLC

[57] ABSTRACT

A flexible tie comprises a flexible strap having a head portion and an opposing end portion. The head portion of the strap includes first and second slots. Loops are formed in the strap by inserting the end portion of through the first and second slots. The first slot is a non-locking slot that permits the strap to move in both directions. The second slot is a locking slot that limits movement of the strap to a single direction. In use, the loops are tightened around a prisoner's arms or legs. The non-locking slot prevents the loops from over-tightening and cutting off circulation to the prisoner's arms and legs.

18 Claims, 6 Drawing Sheets

FLEXIBLE RESTRAINING DEVICE

FIELD OF THE INVENTION

The present invention relates generally to restraining devices for use by law enforcement officials, and more particularly, to flexible, self-locking restraining ties for binding a prisoner's hands or feet.

BACKGROUND OF THE INVENTION

Conventional restraining devices used by law enforcement officials include handcuffs for restraining a person's hands and leg irons for restraining a person's legs. These types of restraining devices typically comprise two heavy metal cuffs that are secured to one another by chains. The cuffs fit around the prisoner's arms or legs and include some form of locking device to prevent their removal.

There are certain circumstances in which an alternate form of restraining device could be useful. For example, law enforcement officials typically carry on a single pair of handcuffs due to the size and weight of the handcuffs. When the law enforcement officer makes multiple arrests, there is a need for additional restraining devices. It would be impractical for the law enforcement officer to carry a large number of handcuffs.

Another problem encountered when using conventional restraining devices occurs when the prisoner is transferred from one law enforcement agency to another. When the transfer is made, one set of handcuffs and/or leg irons is removed from the prisoner and another set of handcuffs and/or leg irons is applied. Such close contact with the prisoner unnecessarily exposes the law enforcement officers to an attack from a potentially dangerous prisoner.

Disposable cuffs for restraining prisoners are sold by several different manufacturers. Representative examples of such devices are shown in U.S. Pat. Nos. 3,186,047 and 5,621,949. Such restraints typically comprise a flexible strap that is used to form loops around the prisoner's arms or legs. The strap includes an enlarged head portion having a slot. The free end of the strap is inserted through the slot to form a loop around the prisoner's wrist or ankle. The slot has a locking pawl that permits one-way movement of the strap. Once the strap is tightened around the prisoner's wrist or ankle, it cannot be loosened. The strap is removed by cutting the strap. To restrain a prisoner, two straps are interlocked The second strap is inserted through the loop in the first strap before it is secured in its respective slot.

Dual-loop restraining devices of the type described above are also known. Representative examples of such devices are shown in U.S. Pat. Nos. 4,910,831; 5,159,728; and 5,443,155. These patents illustrate dual-loop restraining devices that use flexible strap-like elements to bind a prisoner's arms and legs. The straps include enlarged head portions having slots through which a free end of the strap is inserted to form the loops. The strap typically includes a series of teeth which are engaged by a pawl in the slot to lock the strap in place and prevent it from being withdrawn One limitation associated with the dual-loop restraining devices is that they lack any means to adjust the spacing between the loops. For particularly large and bulky prisoners with limited range of motion, the fixed spacing between loops may not be enough to allow the prisoner's hands to be cuffed behind the prisoner's back. Similar difficulty may be encountered when arresting a person with an injury or disability. Also, for a prisoner who poses a safety hazard to the law enforcement officer, it may be desirable to bind his or her hands or feet closely together to reduce the risk associated with the handling of the prisoner. On the other hand, for a prisoner who is cooperative and does not propose a risk to the law enforcement officer, it may be desirable to allow some freedom of movement for the prisoner's comfort.

Another problem with dual-loop restraining devices is that they are more costly to manufacture and have limited utility. Therefore, dual-loop restraining devices are not used as frequently as the conventional single loop restraints.

Accordingly, there is a need for a inexpensive, dual-loop restraining device that allows some adjustment in the distance between the restraining loops and which has greater utility than conventional dual-loop restraining devices.

SUMMARY OF THE INVENTION

Figure 1:
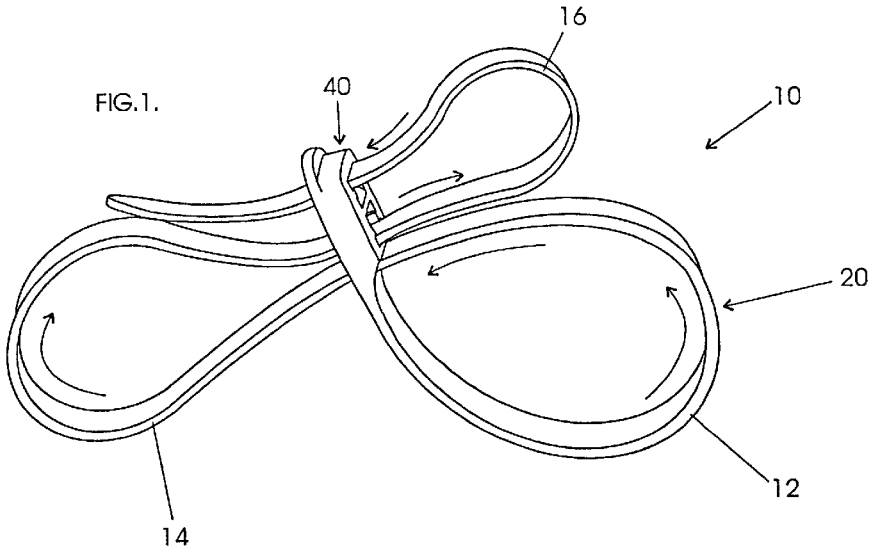
FIG. 1 is a perspective view of the dual-loop restraining device of the present invention configured as a hand cuff.
Figure 2:
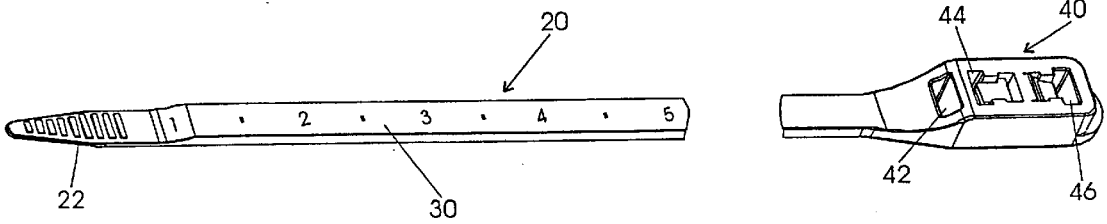
FIG. 2 is a perspective view of the dual-loop restraining device in a flat condition.
Figure 3:
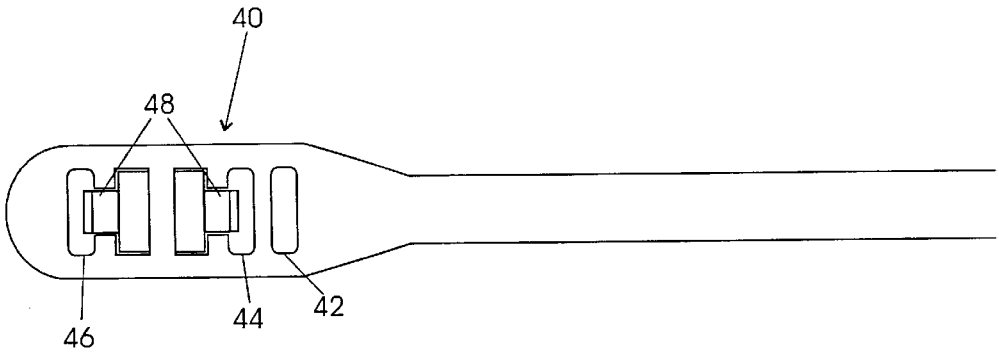
FIG. 3 is a top plan view of the head portion of the dual-loop restraining device.
Figure 4:
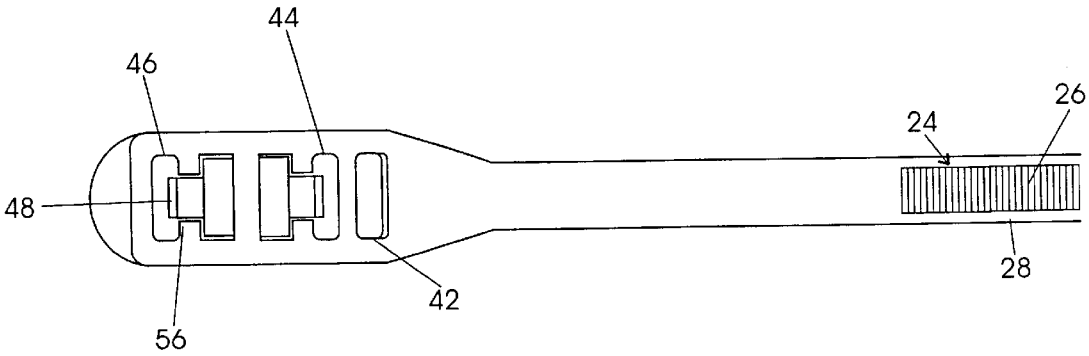
FIG. 4 is a bottom plan view of the head portion of the dual-loop restraining device.
Figure 5:
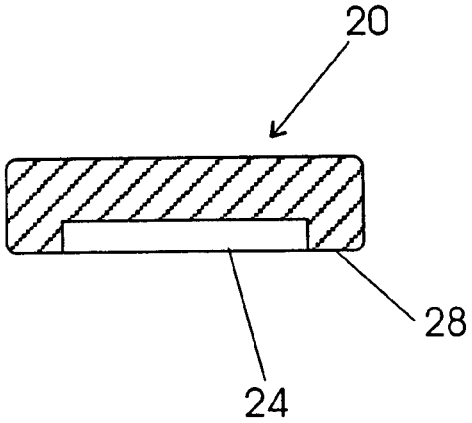
FIG. 5 is a cross-section of the strap.
Figure 6:
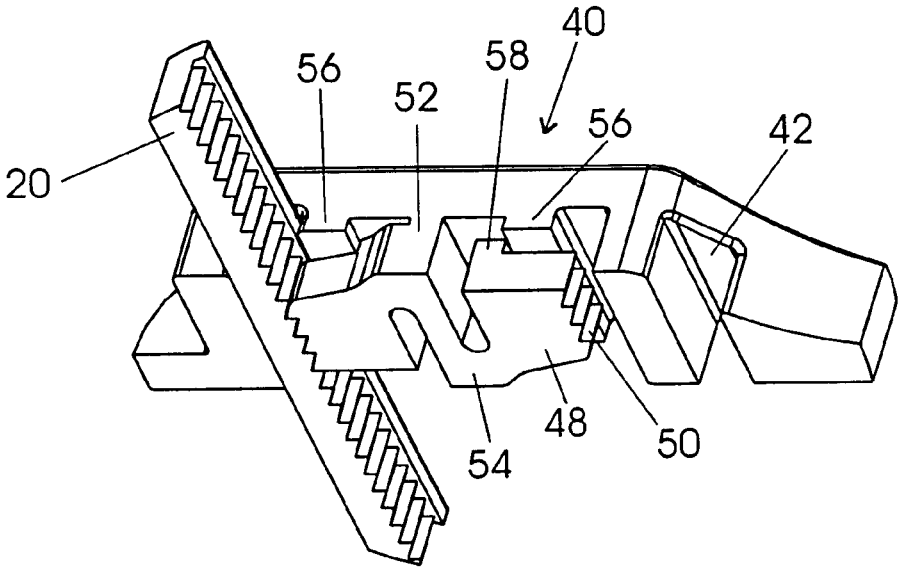
FIG. 6 is a sectional perspective view of the head portion of the strap.

The present invention is a flexible, dual-loop restraining device which can be employed by law enforcement officers in place of handcuffs or leg irons. The dual-loop restraining device of the present invention comprises a flexible strap having an enlarged head portion at one end and an opposing insert end. Three slots are formed in the head portion of each strap. A pawl is located in two of the slots. The pawls engage teeth formed along the length of the strap to allow one-way movement of the strap through the slots. The third slot has no locking mechanism so that the strap is freely moveable within the third slot in two directions.

To use the restraining device, the strap is formed into a first loop and the free end is first inserted through the non-locking slot in the head. A second loop is then formed in the strap and the free end is inserted through one of the locking slots. The loops should be of sufficient size to allow insertion of the prisoner's hands or feet into the loops. The loops are then tightened around the prisoner's arms or legs. The prisoner can then be secured to some fixed structure, such as a post, by forming a third loop around the post and inserting the free end of the strap through the remaining slot in the head portion of the strap.

The non-locking strap serves an important function in the restraining device of the present invention. If a locking slot were used instead, the prisoner's struggles could cause one loop to over-tighten and cut off circulation to the prisoner's hand or foot. The restraining device would have to be cut to restore blood circulation. The non-locking strap allows some movement of the strap to prevent the strap from over-tightening on one wrist or ankle and cutting off blood circulation.

Two straps can also be used together to form an adjustable handcuff. In this case, each strap is formed into a loop by inserting the free end of the strap through a first locking slot in the head portion of the same strap. After forming a loop in each strap, the straps with the loops formed therein are interconnected by inserting the free end of each strap through a second locking slot in the opposing strap. Once the straps are interconnected in this manner, the locking mechanism prevents the straps from being pulled apart.

In use, the restraining device is applied to the arms or legs of a prisoner by inserting the prisoner's hands or feet through each loop. The loops are tightened around the prisoner's arms or legs by grasping and pulling on the head portions of the straps. Again, the one-way locking mechanisms within the slots prevent the loops from loosening after they are tightened around the prisoner's arms or legs. The prisoner's arms or legs will be initially spaced by an initial separating distance. If the prisoner is uncooperative or becomes violent or unruly, the loops of the restraining device can be pulled together by grasping the free ends of each strap and pulling them apart from one another. When the free ends of the straps are pulled apart, the loops are drawn towards one another.

The restraining device can be quickly and conveniently employed by law enforcement officers in place of handcuffs. Because the restraining device is lightweight and inexpensive to produce, a plurality of such devices can be carried by law enforcement officers. This aspect of the invention is particularly useful when the need for multiple arrests arises. Also, because the restraining device is disposable, there is no need to interchange the restraining device when a prisoner is transferred from one law enforcement agency of another.

Other objects and advantages of the present invention will become apparent and obvious from a study of the following description and the accompanying drawings, which are merely illustrative of such invention.

DETAILED DESCRIPTION OF THE INVENTION

Referring now to the drawings the flexible, dual-loop restraining device of the present invention is shown therein and indicated generally by the numeral 10. The dual-loop restraining device 10 comprises an elongated, flexible strap 20 having an enlarged head portion 40. The strap has a tapered end 22 opposite the head portion 20. The strap 20 includes a flat top surface. A channel 24 is formed in the bottom surface of the strap 20. The channel 24 includes a series of closely spaced, positive locking teeth 26 which are bounded on each side by smooth, rounded rails 28. Each of the teeth 26 includes a sloped camming surface and a substantially vertical locking surface. A scale 30 is formed on the top surface 42 of the strap 20.

Figure 7:
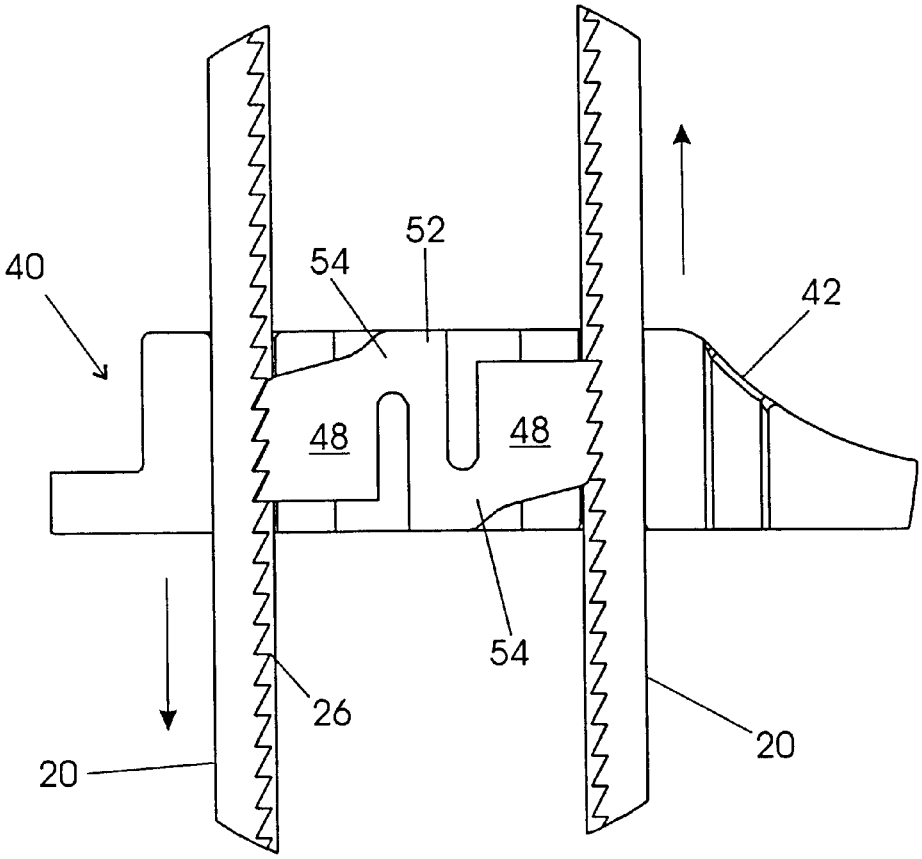
FIG. 7 is a longitudinal section view of the head portion with the flexible straps inserted through the slots in the head portion.

The head portion 40 includes three slots—a non-locking slot 42 and a pair of locking slots 44, 46. The non-locking slot 42 has smooth sidewalls to allow the strap 20 to move freely therein in two directions. Each locking slot 44, 46, in contrast, is designed to allow movement of the strap 20 in only a single direction. Each locking slot 44, 46 includes a pawl 48 having a series of locking teeth 50 which are designed to engage the locking teeth 26 on the strap 20. The pawl 48 allows the strap 20 to be inserted through the slot 44, 46 in only a single direction. The pawl 48 flexes away from the strap 20 as the strap is inserted into the locking slot 44, 46. When the strap 20 moves in the opposite direction, the pawl 48 locks against the strap 20 to prevent the backward movement of the strap 20. Thus, the pawl 48 prevents the withdrawal of the strap 20 from the slot 44, 46 once the strap 20 is inserted into the locking slot 44, 46. The pawls 24 in the locking slots 44, 46 are oriented to allow insertion of the strap 20 through the locking slots 42, 44 in opposite directions. The arrows in FIG. 7 indicate the direction of insertion.

In a preferred embodiment of the invention, the pawls 48 are integrally molded with a central section 52 of the head portion 40. Each pawl 48 includes a narrow tie section 54 that joins the pawl to the center section 52. One potential problem is the pawl 48 may fail, i.e. be pulled through the slot, when subjected to excessive forces. To minimize this danger, the present invention incorporates a stop member 56 in each locking slot 44, 46 to keep the pawl 48 aligned in its respective slot 44, 46. The stop member 56 in the disclosed embodiment comprises a rail integrally formed with opposing sidewalls of the slot 44, 46. The pawl 48 includes a ledge 58 that contacts the stop member 56. Together, the stop member 56 and ledge 58 prevent the pawl 48 from twisting in the slot 44, 46. This feature reduces the failure rate of the pawl 48, but is not an essential element of the invention.

Figure 8:
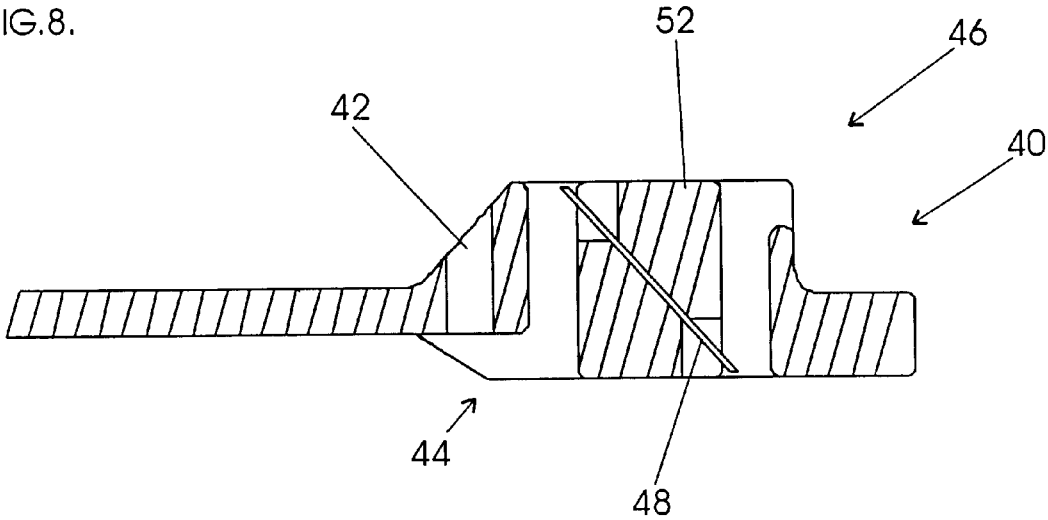
FIG. 8 is a longitudinal section view through the head portion of an alternate embodiment of the strap.

FIG. 8 shows an alternate construction for the head portion 40. In this embodiment, the pawls 48 comprise a metal barb embedded in the center portion 52 so that the ends of the barb extend into respective locking slots 44, 46.

The restraining device 10 is preferably molded as a single piece from a light-weight, thermoplastic material such as engineering grade, Nylon or polyurethane. All corners and edges are preferably radiused to ensure that the straps 20 do not cut into the prisoner's skin when tightened.

To use the restraining device 10 of the present invention, the strap 20 is formed into a first loop 12 by inserting the tapered end 22 through the non-locking slot 42 in the head portion 40. The strap 20 is pulled through the non-locking slot 42 until the loop 12 is the desired size. The strap 20 is then formed into a second loop 14 by inserting the tapered end 22 of the strap 20 through one of the locking slots 44, 46. The strap 20 is pulled through the locking slot 44, 46 until loop 14 is the desired size. The loops 12, 14 should be large enough to allow the prisoner's arms or legs to be inserted into the loop 12, 14. The restraining device 10 is now ready for use.

Law enforcement officers can use the restraining device 10 of the present invention in place of handcuffs or leg irons. To apply the restraining device 10 to a prisoner, the prisoner's hands or feet are inserted through the loops 12, 14, which are then tightened around the prisoner's arms or legs. The loops 12, 14 are tightened by grasping the head portion 40 of each strap element 12 and pulling it against the prisoner's arm or leg. Loop 12 is tightened first followed by loop 14. Once tightened, the loops 12, 14 cannot be loosened. The restraining device 10 can be removed only by cutting the strap 20. Also, if it is desired, the prisoner can be secured in a fixed location by forming a third loop 16. The prisoner is secured in a fixed location by extending the strap 20 around a fixed structure, such as a post, and inserting the strap 20 through the remaining locking slot 44, 46 to form the third loop 16 around the post.

The non-locking slot 42 serves an important function in the restraining device of the present invention. If loops 12, 14 are formed using the two locking slots, the prisoner's struggles could cause one loop 12, 14 to over-tighten and cut off circulation to the prisoner's hand or foot. The restraining device 10 would have to be cut to restore blood circulation. The non-locking slot 42 allows some movement of the strap 20 to prevent the strap 20 from over-tightening on one wrist or ankle and cutting off blood circulation.

Figure 9:
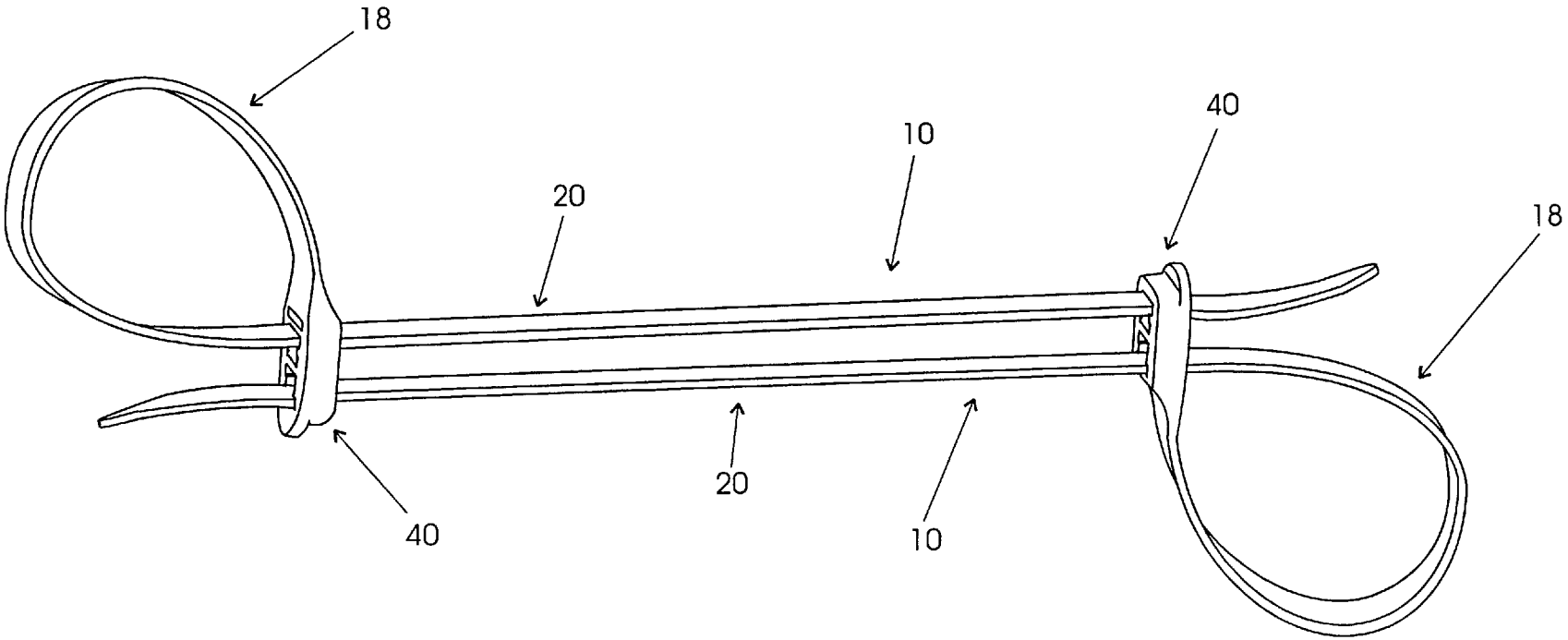
FIG. 9 is a perspective view showing two straps configured as a handcuff.

FIG. 9 shows an alternate method of using the restraining device 10. FIG. 9 shows an adjustable handcuff or leg iron formed using two restraining devices 10 of the present invention. To form the adjustable cuff of FIG. 9, a loop 16 is formed in each strap 20 by inserting the end portion 22 of the strap 20 through a first locking slot 44 in the head portion 40. After a loop 18 is formed in each strap 20, the straps 20 are then connected to one another by inserting the end portion 22 of each strap 20 through the second locking slot 46 in the head portion 40 of the other strap 20.

To apply the device shown in FIG. 9 to a prisoner, the prisoner's hands or feet are inserted through the loops 16, which are then tightened around the prisoner's arms or legs. The loops 16 are tightened by grasping the head portion 40 of each strap 20 and pulling it against the prisoner's arm or leg. Once tightened, the loops 16 cannot be loosened. The restraining device 10 can be removed only by cutting the straps 20.

Initially, the loops 16 are separated by a predetermined separating distance d. For example, for use as a substitute for leg irons, an initial separating distance of approximately 11 or 12 inches is suitable. For handcuffs, an initial separating distance of approximately 4–6 inches is suitable. If the prisoner resists arrest or becomes violent, the loops 16 can be quickly pulled together by grasping and pulling the ends 22 of the straps 20. When the ends 22 of the straps 20 are pulled apart, the loops 16 will be drawn towards one another. In other words, the separating distance d decreases when the straps 20 are pulled apart. Again, the locking mechanism prevents the loops 16 from being pulled apart. The individual strap elements 20 can be formed into loops as described above and conveniently carried in bundles by a law enforcement officer.

Figure 10:
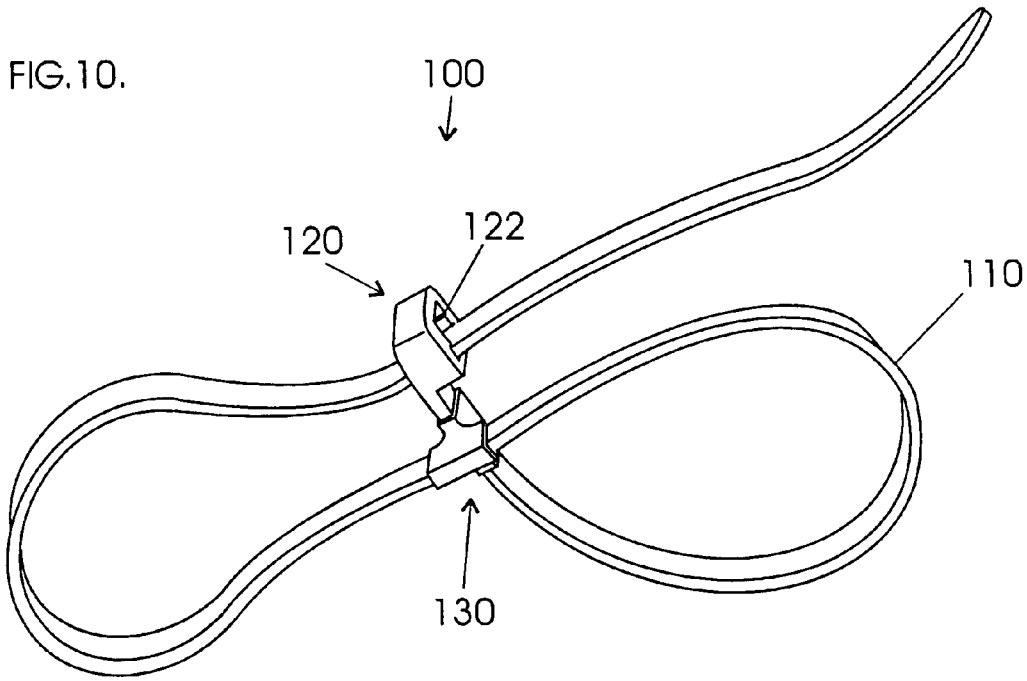
FIG. 10 is a perspective view showing an alternate embodiment of a dual-loop restraining device.
Figure 11:
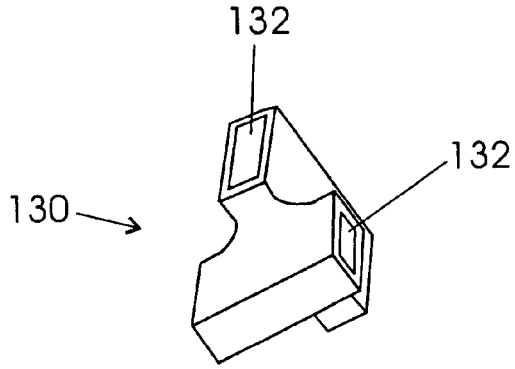
FIG. 11 is a perspective view of the connector used in the alternate embodiment.

FIG. 10 shows an alternate embodiment of the invention indicated generally by the numeral 100. The embodiment shown in FIG. 10 comprises a single strap 110 having an enlarged head portion 120 at one end thereof and a separate connector 130. The strap 110 includes a plurality of serrations or teeth (not shown) along the length thereof. The strap 110 is formed in the same manner as strap 20 described above. Therefore, the details of the strap 110 will not be repeated here.

The head portion 120, in contrast to the previous embodiment, has a single, locking slot 122. The locking slot 122 includes a pawl 48 as previously described for engaging the serrations of the strap 110 and limiting the movement of the strap 110 in only a single direction. The connector 130 is a molded component having two slots 132 formed therein. The slots 132 are sized to receive the strap 110. The slots 132 have smooth, non-gripping walls that allow the strap 110 to slide freely in both directions.

In use, the strap 110 is inserted through a first slot 132 in the connector 130, folded back into a loop 102 and inserted through a second slot 132 in the connector 130. The strap 110 is then inserted through locking slot 122 in the head portion 120 forming a second loop 104.

To apply the restraint 100, the prisoner's arms or legs are inserted through respective loops 102, 104 and the strap 110 is pulled until the loops 102, 104 are snug against the prisoner's extremities. Again, the locking mechanism prevents the strap 110 formed being pulled out of the locking slot 122. The only way to remove the restraining device 100 is to cut the strap 110.

The present invention may, of course, be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A flexible tie comprising:

a) a flexible strap including a head portion at one end thereof and an opposing insert end;

b) a non-locking slot formed in the head portion of said strap through which said strap is adapted to pass, wherein said non-locking slot permits movement of said strap in two directions; and c) at least one locking slot formed in the head portion of said strap through which said strap is adapted to pass, said locking slot being formed between an outer end of said head portion and said non-locking slot and allowing movement of said strap in only a single direction.

2. The flexible tie of claim 1 wherein said locking slot includes a pawl for engaging said strap.

3. The flexible tie according to claim 2 further including a stop disposed in said locking slot to limit rotational movement of said pawl and prevent said pawl from being pulled through said locking slot.

4. The flexible tie of claim 2 wherein said strap includes a plurality of teeth that are engaged by said pawl in said locking slot.

5. The flexible tie of claim 2 wherein said pawl is a metal barb.

6. A flexible tie comprising:

a) a flexible strap including a head portion at one end thereof and an opposing insert end;

b) a non-locking slot formed in the head portion of said strap through which said strap is adapted to pass, wherein said non-locking slot permits movement of said strap in two directions; and c) at least two locking slots formed in the head portion of said strap through which said strap is adapted to pass, wherein said locking slots allow movement of said strap in only a single direction.

7. The flexible tie according to claim 6 wherein a first one of said locking slots allows movement of said strap in a first direction and said second one of said locking slots allows movement of said strap in a second direction opposite to said first direction.

8. The flexible tie of claim 6 wherein each said locking slot includes a pawl for engaging said strap.

9. The flexible tie according to claim 8 further including a stop disposed in said locking slot to limit rotational movement of said pawl and prevent said pawl from being pulled through said locking slot.

10. The flexible tie of claim 8 wherein said strap includes a plurality of teeth that are engaged by said pawls in said locking slots.

11. The flexible tie of claim 8 wherein said pawls are metal barbs.

12. The flexible tie according to claim 11 said pawls are formed from a single metal barb having a central portion embedded in said head portion between said locking slots and two end portions extending into respective locking slots.

13. A flexible tie comprising:

a) a flexible strap including a head portion at one end thereof and an opposing insert end;

b) a slot having side walls formed in the head portion of said strap through which said strap is adapted to pass;

c) a locking pawl disposed in said slot for engaging said strap to prevent said strap from being withdrawn from said slot, said pawl including an abutment surface oriented generally parallel to an axis of said slot; and d) a rail integrally formed in said side walls of said slot and extending generally parallel to an axis of said slot to engage said abutment surface of said pawl to limit rotational movement of said pawl and to prevent said pawl from being pulled through said slot.

14. The flexible tie according to claim 13 wherein said stop comprises a rail extending parallel to an axis of said slot.

15.The flexible tie according to claim 13 wherein said pawl is integrally formed with said head portion.

16. The flexible tie of claim 13 wherein said strap includes a plurality of teeth that are engaged by said pawl in said slot.

17. A flexible tie comprising:

a) a flexible strap including a head portion at one end thereof and an opposing insert end;

b) first and second locking slots formed in the head portion of said strap through which said strap is adapted to pass, said first and second locking slots being separated by a central section of said head portion;

c) first and second locking pawls disposed in respective locking slots for engaging said strap to prevent said strap from being withdrawn from said locking slots, said first and second locking pawls are formed from a single metal barb having a central portion embedded in said central section of said head portion and two end portions extending into respective locking slots, said pawls oriented such that said first pawl permits movement of said strap in a first direction and said second pawl permits movement of said strap in a second direction opposite to said first direction.

18. A flexible tie comprising:

a) a flexible strap including a head portion at one end thereof and an opposing insert end;

b) a locking slot formed in the head portion of said strap through which said strap is adapted to pass;

c) a locking pawl disposed in said slot for engaging said strap to prevent said strap from being withdrawn from said slot; and d) a connector formed separately from said head portion and moveable along the length of said flexible strap, said connector having a pair of non-locking slots.

* * * * *